US005366363A

United States Patent [19]

Good et al.

[11] Patent Number: 5,366,363

[45] Date of Patent: Nov. 22, 1994

[54] MODULAR APPARATUS FOR COMPRESSION FORMING OR CALIBRATING OF POWDER METAL WORKPIECES

[75] Inventors: Hermann Good, Buchs/SG, Switzerland; Peter Rauch, Dünserberg, Austria

[73] Assignee: Werkzeugbau Alvier AG, Buchs/SG, Switzerland

[21] Appl. No.: 930,848

[22] Filed: Aug. 14, 1992

[30] Foreign Application Priority Data

Aug. 17, 1991 [CH] Switzerland ..... 02418/91-4

[51] Int. Cl.[5] ..... B22F 3/00

[52] U.S. Cl. ..... 425/78; 425/352; 425/356; 425/414; 425/418

[58] Field of Search ..... 425/78, 150, 352, 354, 425/355, 356, 414, 418, 422

[56] References Cited

U.S. PATENT DOCUMENTS

| | | | |
|---|---|---|---|
| 2,561,735 | 7/1951 | Haller . | |
| 3,353,215 | 11/1967 | Haller | 425/78 |
| 3,394,432 | 7/1968 | Laurent . | |
| 3,677,671 | 7/1972 | Martin | 425/78 |
| 3,677,672 | 7/1972 | Harrington | 425/78 |
| 3,694,127 | 9/1972 | Takahashi et al. | 425/352 |
| 3,843,287 | 10/1974 | Fowler | 425/352 |
| 3,891,367 | 6/1975 | Signora | 425/78 |
| 3,909,167 | 9/1975 | Signora . | |

FOREIGN PATENT DOCUMENTS

| | | | |
|---|---|---|---|
| 328264 | 3/1976 | Germany . | |
| 2508065 | 9/1976 | Germany . | |
| 57-199598 | 12/1982 | Japan | 425/418 |

OTHER PUBLICATIONS

Patent Abstracts of Japan vol. 7, No. 50 (M-197) (1195) 26, Feb., 1983 & JP-A-57 199 598 (Tokyo Shibaura Denki K.K.) 7 Dec. 1982.

*Primary Examiner*—Charles S. Bushey

*Attorney, Agent, or Firm*—Frishauf, Holtz, Goodman & Woodward

[57] ABSTRACT

To form and compact a powdered metal workpiece (W) having an outer spiral circumference, for example a helical gear, the apparatus has a press mold (21) in a compaction press. This mold can be used for manufacture or for sizing or calibrating workpiece dimensions. A first rotatable and axially movable plunger, punch or ram (16) is movable towards the press mold, and a second rotatable or axially movable plunger or punch or ram (27) is movable through the press mold. To ensure and control rotation of the first (16) plunger, a helical cam system (13, 15) formed by a core element (15) having a spiral outer contour in engagement with a matrix or nut element (13) is provided, the system being coupled to the first plunger (16) by a gear transmission (11, 12) coupled to the matrix element and to the first plunger, punch or ram (16). An additional centering plunger, or core plunger, for example to make an axial bore (3) in the workpiece, or additional concentric portions on the workpiece, such as a smooth hub (4) and a geared hub (2) at the other side, are positioned concentrically to the first plunger and the press mold. The cam system is readily replaceable with spiral surfaces of different spiral angles, so that different workpieces can be easily made without extensive disassembly and reassembly of the press.

12 Claims, 5 Drawing Sheets

MODULAR APPARATUS FOR COMPRESSION FORMING OR CALIBRATING OF POWDER METAL WORKPIECES

Reference to related patents, the disclosure of which is hereby incorporated by reference:

U.S. Pat. No. 2,561,735, Haller

U.S. Pat. No. 3,394,432, Laurent.

Reference to related publications:

Austrian Patent 328,264

German 25 08 065, Fowler.

1. Field of the Invention

The present invention relates to the manufacture of workpieces made of powdered metal, particularly sintered powdered metal, and more particularly to an apparatus to make such workpieces which have an outer contour of helical or spiral shape, preferably with adjacent hub portions, for example a helical gear. The hub portions may, also, carry gear teeth, or be smooth at the outer circumference, or have positive engagement elements such as grooves, wedge-like projections, splines and the like.

2. Background

When press-forming workpieces having spiral gears at the outer circumference, it has been found that the press forms are subject to high wear and tear, if the rotary movement required by the press form to form the spiral gears is caused solely by cooperation of the contours of a punch with a matrix. It has already been proposed to cause the rotary movement of the punch by a hydraulic copying apparatus, known for example from rotary machinery, such as turret lathes. Leakages of hydraulic fluid are practically unavoidable. Further, the temperature dependent compressibility of the hydraulic compression fluid does not permit precise uniform rotary movement of the punch in the press form, required by current precision manufacturing specifications. The relative play, at the maximum, is a few thousands of a millimeter. Such accuracies cannot be obtained by apparatus of this type during the pressing process.

Austrian Patent 328,264 discloses has a two-part press form in order to make workpieces with spiral outer contours. The upper part is fixed. The powder mass is compressed or compacted by two axially movable punches or plungers from the bottom and from the top. The upper plunger has an outer gearing corresponding to the spiral gearing of the workpiece. During the pressing process, it is rotated directly by engagement with a fixed gear nut block. The rotary movement in this arrangement is obtained by direct cooperation of the inclined gearing of the plunger with that of the fixed nut block. Wear will appear directly on the tool which defines the final shape.

It is known that in press forms having fixed step matrices, and one-sided compaction of the powder, the distribution of density of the compacted material may be non-uniform. In the above referred-to two-part press form, it is not possible to vary the fill volume on any one stage. This, however, is required due to the different apparent densities of the starting powder mixture which is used. This non-uniformity has been determined by experience in actual practice. The press arrangement described in this patent cannot be used with a simple or one-part press, since compaction must be obtained uniformly from both sides.

German Patent 25 08 065 describes an arrangement in which rotary movement is transmitted indirectly to the plunger by a ball circulating mechanism, which has spiral contours or grooves which correspond to the spiral contours or the pitch of the spiral of the workpiece to be produced. This rotary movement is very complex and expensive to make. Rotary drives must be provided for each specific workpiece anew. The manufacturing costs for these rotary drives may exceed the manufacturing costs of the entire remainder of the apparatus.

U.S. Pat. No. 2,561,735, Haller, describes an arrangement in which rotary movement of the plunger or generating piston is obtained by a gearing or gear transmission which causes rotation of the plunger upon axial movement between the plunger and a press form. The gearing is formed by a rack which drives a worm via a pinion. The worm is in engagement with a worm wheel which is coupled to the plunger. It is difficult, in this arrangement, to change the angle of inclination of desired workpieces since a new transmission with different transmission ratios must be provided for each differently dimensioned spiral gear to be manufactured. The transmission ratios must be carefully matched to the pitch of the spiral gear. It is also difficult to maintain accuracy since the pinion normally has a small diameter, and play arises between the rack and the pinion. This play interferes with precise introduction of the plunger into the press form, so that the required accuracy of introduction cannot always be assured.

U.S. Pat. No. 3,394,432, Laurent, is directed to an arrangement in which the rotary movement of the plunger or ram is generated by a ring concentric with the ram. The ring has an inner inclined gearing and an outer inclined gearing. The inner inclined gearing is in engagement with a gear which is also engaged with the ram or plunger; the outer gearing, which is an inclined gearing, is in engagement with a matching inclined gearing in the housing. Resetting this apparatus for workpieces having a different pitch than the one for which it is first designed is very complex. The ring, the gear and the housing must all be replaced with parts designed for the specific desired pitch of the spiral of the gear to be made. This requires not only manufacture of expensive parts and components, but extensive disassembly and re-assembly of the apparatus. Manufacture of workpieces having a helical gearing with a gear or inclination angle of 45° or more is not possible because a self-locking or self-binding effect will occur between the ring and the gear. Thus, gears having a high inclination angle, that is, in which the teeth are slanted at a large angle with respect to the gear axis, cannot be made in this apparatus.

No apparatus is known in accordance with the prior art in which the same press forms which make the workpieces can also be used for high-precision re-calibrating or re-sizing, in which already sintered workpieces can be subjected again to pressures in the order of the pressures used to make the powdered metal workpieces in the first place. Thus, already made and sintered workpieces can be inserted into the matrix and subjected to another compression cycle. To insert already manufactured workpieces, high torques are required to act on the workpieces to be calibrated already outside of the matrix, so that the workpiece will be inserted under the appropriate corresponding angle into the matrix.

THE INVENTION

It is an object to provide a press form to manufacture workpieces having an outer helical contour, particularly helical or gears made of powdered metal material, which, later on, can be sintered, in which the press form is of modular construction, and rotary movement of the plunger or ram can be obtained with high precision by inexpensive, easily exchanged components, while permitting transmission of high torques to the plunger or ram; and more particularly to permit the manufacture of such workpieces, selectively, with hub portions at one or both sides thereof which, themselves, may have inclined, that is, helical or contours or axially straight teeth, or have smooth surfaces, which may further be interrupted by ridges, wedges, and the like; the foregoing should be possible to be carried out on standard presses, independently of the particular pressing process or system which is being used; and, further, the same apparatus should also be suitable for subsequent sizing or calibrating of the workpieces after having been sintered.

Briefly, the apparatus has a press mold, optionally for a sizing or calibrating mode. Two plungers are provided, a first plunger which is rotatable and axially movable, and a second, likewise rotatable and axially movable plunger. The plungers are movable against each other. A helical pattern connecting system is provided which, preferably, has an interengaging matrix element and a block element, the connecting system being coupled to a drive transmission. The drive transmission is arranged to rotate one of the plungers upon axial movement thereof relative to the press mold. The helical pattern connecting system controls the rotary movement of the respective plunger or punch or ram when such relative movement occurs.

To change pitch, it is only necessary to replace the matrix element and block element, respectively, that is, the helical pattern of the connecting system. All other parts can remain the same. At least one of the plungers, thus, is caused to rotate by the connecting system which is easily assembled, replaced, and which can be manufactured inexpensively. The connecting system controls the respective plunger or ram or punch by causing, indirectly, rotation upon axial movement thereof in such a manner that the inclined or spiral contours to be generated will result.

The system permits manufacture of geometrically complex workpieces having spiral contours from powdered material in simple and economic manner.

In accordance with a preferred feature of the invention, the spiral pattern and connecting system, which controls the rotary movement, are located on a guide plate opposite each other, and include a connecting block element or core having a spiral contour and a connecting matrix element likewise having a spiral contour complementary with the core. The connecting matrix interengages during the pressing process, with the core, which is secured to the guide plate, and thus is caused to rotate. This rotation of the matrix is then transferred by the transmission gearing, typically merely gear wheels or spur gears, to the upper plunger or punch or ram, which can be exchangeable.

If the gear coupled to the connecting core is larger than the gear coupled to the plunger, it is readily possible to make workpieces having widely varying spiral angles of the teeth, and especially angles of teeth which could not be made in accordance with the prior art.

The modular construction of the arrangement in accordance with the present invention permits changing over the system and apparatus to manufacture workpieces with different geometry rapidly and simply. All the plungers and core rods and the like can be moved axially; thus, the fill volumes for the powdered workpiece material can be readily adjusted at each stage.

DRAWINGS

Figure 4A:
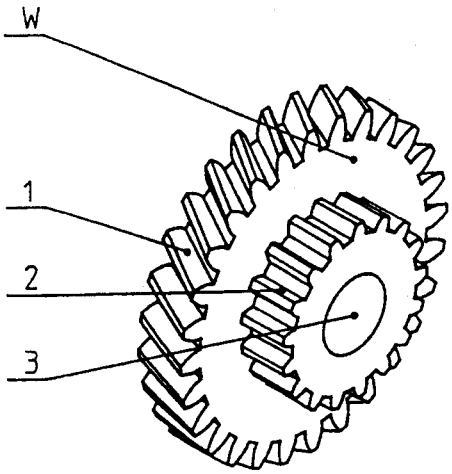
Figure 4B:
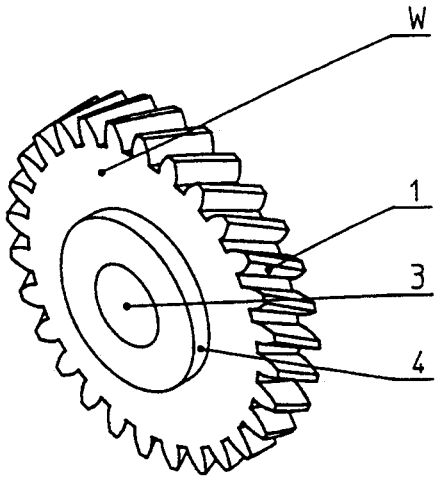

FIG. 4*a* is a right-side isometric view of a typical workpiece;

FIG. 4*b* is a left-side isometric view of the workpiece of FIG. 4*a;*

Figure 4C:
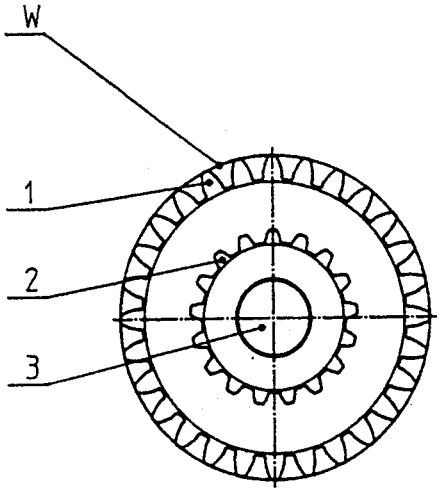

FIG. 4*c* is a top view of the workpiece looked at from the side of FIG. 4*a;*

Figure 4D:
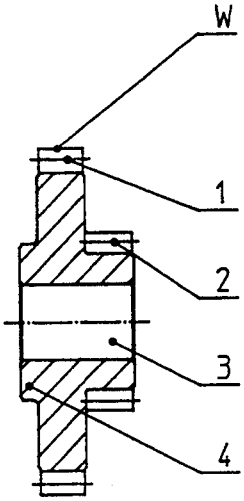

FIG. 4*d* is a vertical cross-sectional view of the workpiece of FIGS. 4*a*, 4*b*, 4*c;*

Figure 5A:
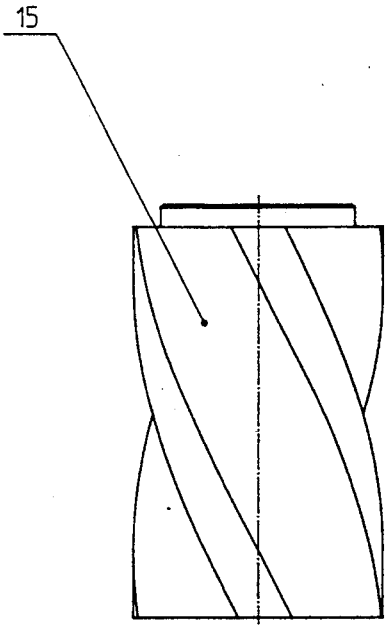
Figure 6A:
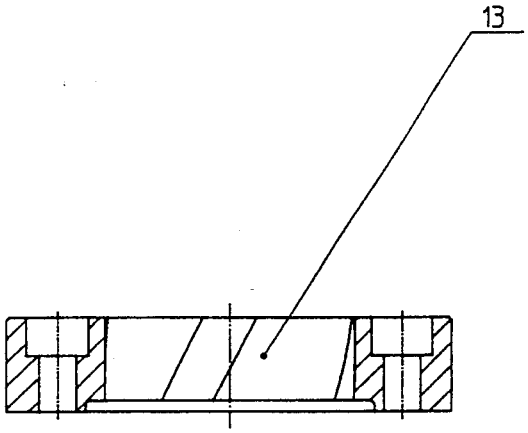
Figure 5B:
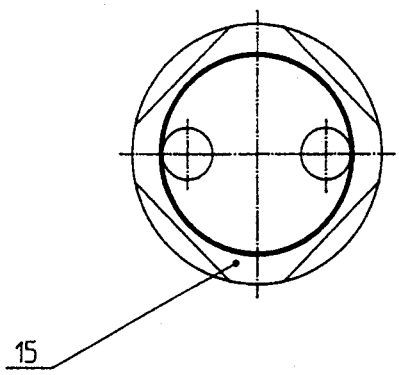
Figure 6B:
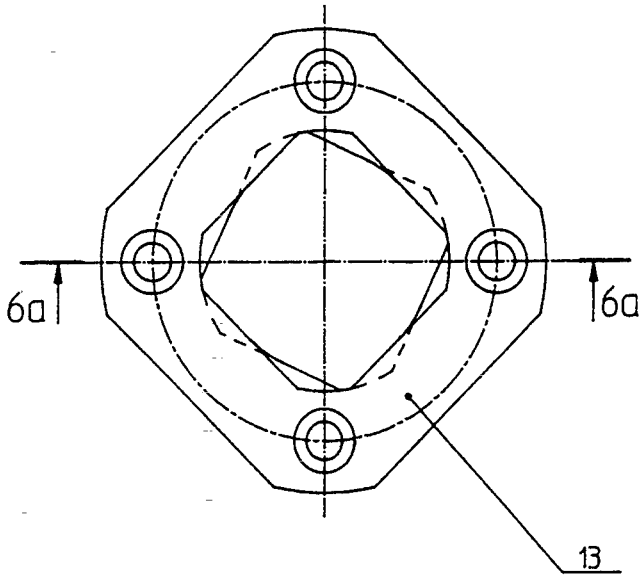

FIG. 5*a* is a side view of the spiral pattern core element;

FIG. 5*b* is a top view of the spiral pattern core element;

FIG. 6*a* is a cross section through the spiral pattern matrix element taken along line 6*a*–6*a* on FIG. 6*b*; and FIG. 6*b* is a top view of the spiral pattern matrix element.

DETAILED DESCRIPTION

The invention will be described with reference to an example in which the workpiece W—see FIG. 4—is a spiral gear 1 having two hub portions 2, 4, at opposite sides, in which the hub portion 2 is formed with a straight or axially parallel gear, and the other hub portion 4 is formed as a cylindrical projecting hub. A bore 3, to receive a shaft, passes through the workpiece W. Of course, the apparatus to be described can be used to form other workpieces or gear elements having inclined or spiral gears extending at the same angle or at different angles at respective hub portions.

Figure 1:
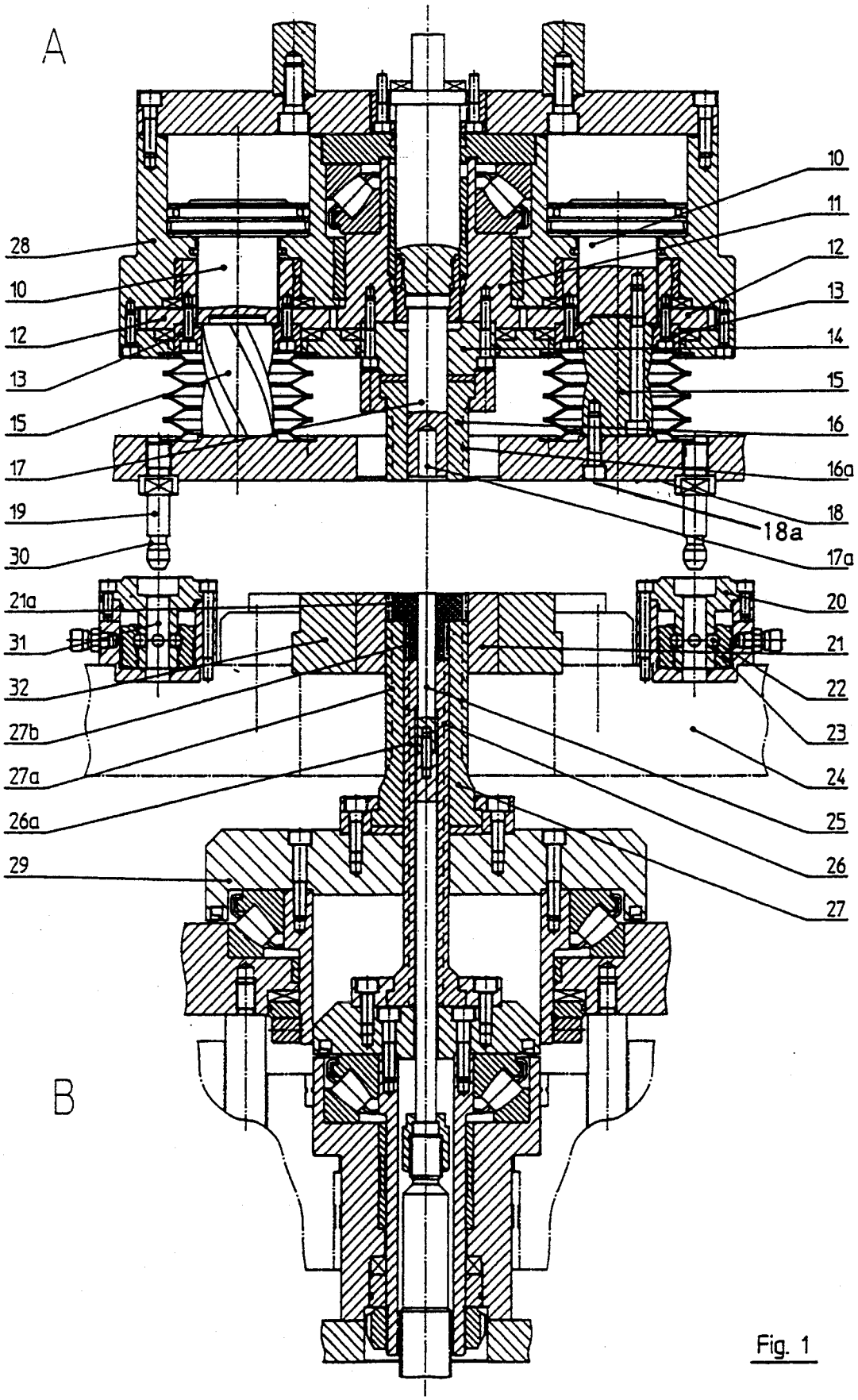
FIG. 1 is a longitudinal sectional view of the press illustrating its position to start the pressing cycle, that is, in the material fill position.
Figure 2:
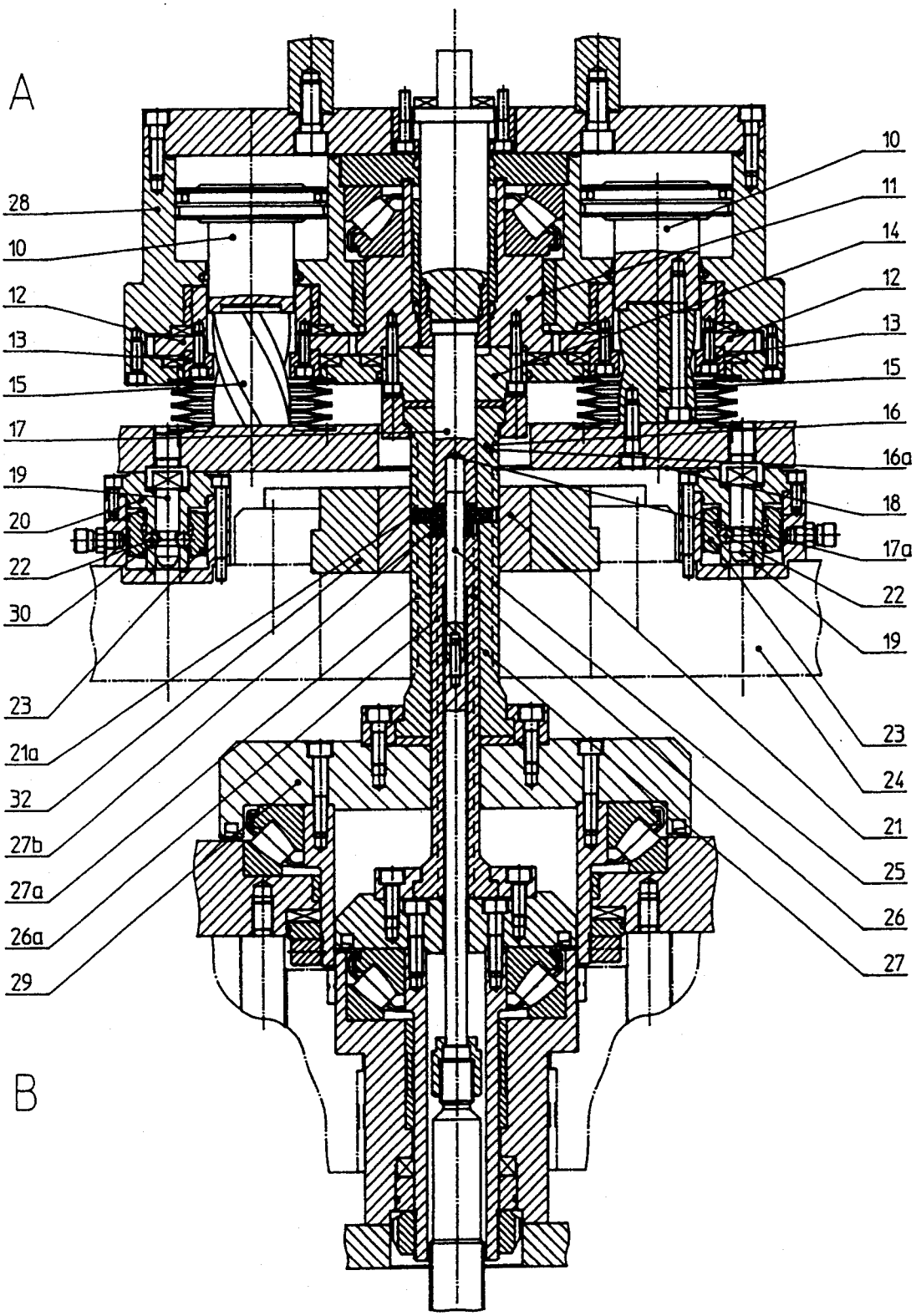
FIG. 2 is a view similar to FIG. 1 with the press in pressing condition.
Figure 3:
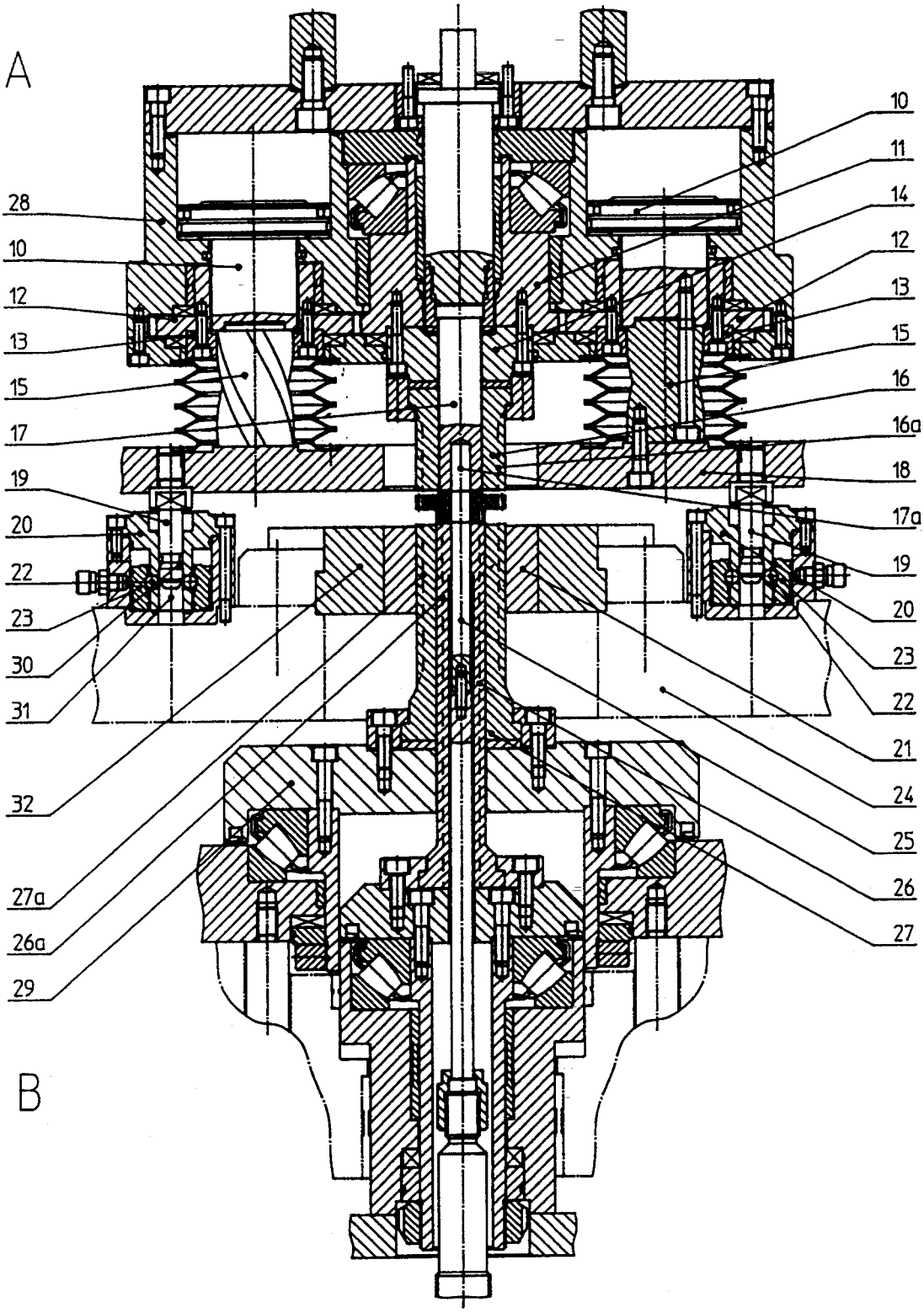
FIG. 3 is a longitudinal view similar to FIG. 1 with the press in ejection position.

Referring now to FIGS. 1–3, and, first, to FIG. 1 which illustrates all the components of the apparatus in accordance with the present invention:

The apparatus has an upper part A which, basically, includes a guide plate 18 and an upper housing part 28 and two axially movable, rotatable coaxial plunger dies or punches or rams 16, 17. The apparatus further has a lower portion B which, basically, includes an axially movable cover plate 24 carrying a press mold 21, and a lower plunger, punch or ram holder 29, and rotatable and axially movable plunger dies, punches or rams 26, 27, as well as a core plunger 25. The plunger 27 has an outer spiral contour 27*a*. The upper part A and the lower part B are clamped together by suitable clamping arrangements in the compaction apparatus, in accordance with well known technology, and thus are not shown in the drawings. They are suitable for installation in any standard compaction press.

The press mold 21 has a helical inner contour 21*a*.

The plunger die 16 is formed with helical contours 16*a* corresponding to the helical contours, that is, the helical gears to be made in the workpiece W. The plunger die 16 is secured in the plunger receiver 14 which, in turn, is rigidly connected with an intermediate gear 11. The intermediate gear 11 is driven by two gears 12, which are coupled to connecting members 13 forming gear shape controlling or patterning connecting matrices 13. When the upper part moves vertically, that is, in a vertical stroke, the connecting matrices 13 engage with the shape controlling connecting patterning cores forming cams 15 and thus, indirectly, rotate the plunger die 16.

The shape controlling connecting system formed by the connecting matrix or "nut" 13 and the connecting cam core 15 thus controls the angle of inclination and the shape of the gearing 1 on the workpiece W.

Two shape controlling connecting core elements 15 are rigidly screw connected at the lower end with the guide plate 18 of which only one screw 18*a* is shown and at the upper end with the piston 10. They are surrounded by bellows to prevent contamination. The pistons 10, and hence the guide plate 18, are axially moved relative to the upper housing portion 28, and retained therein.

Two coupling bolts 19 are located at the outer edge of the lower side of the guide plate 18. They are generally cylindrical, have a lower conical end, and are formed with a circumferential locking groove 30 upwardly from their lower end. The guide or coupling bolts 19 are engageable into a coupling bore 31 formed in the plate 24. Stop or abutment elements 20 are located upwardly above the plate 24, and secured thereto by suitable bolts. Pistons 23, pneumatically or hydraulically actuated, are provided to move balls 22 into the locking grooves 30 of the coupling bolts 19 when the plate 18 is moved downwardly. The bolts 19 are thus locked by the balls 22; this also locks the guide plate 18 to the plate 24. The guide plate 18 engages the stops 20. A fluid control of the piston 23 permits exact synchronization of the movement of the plunger die 16 with respect to the spiral inner contour 21*a* of the press mold or squeeze mold 21.

The plunger 17 is guided within the plunger 16. The plunger 17 is formed with a bore 17*a* at its lower end to permit reception of the core plunger or punch 25 when the compaction step portion of the cycle is carried out, as will be explained in connection with FIG. 2.

A clamping ring 32 clamps the mold 21 to the plate 24 by force engagement therewith. The stops 20 exend above the mold 21 by a predetermined level, so that the plunger or ram or punch 16 can rotate by some degrees upon compaction before it enters into the mold 21.

The external spiral contours 27*a* of the lower plunger 27 cooperate with complementary contours 21*a* of the mold 21. A second, rotatable plunger 26 has outer gear profiles 26*a* which are axially parallel to form the hub portion 2. The plunger 27 has a complementary outer gear shape 27*b*; it is axially movable. The plunger 26 is centrally apertured, with a central bore, in order to receive the rotatably retained and axially movable core plunger 25 to form the central bore 3 in the workpiece W (see FIG. 4).

Operation, with reference to FIGS. 1, 2 and 3 to form the workpiece shown in FIG. 4, collectively:

The apparatus illustrated in FIG. 1 is in the powder filling or insertion position. The mold 21 and the plate 24, respectively, are in their highest, upward position. The upper part A is in the highest starting position. The plungers or rams 16 and 17 are in the pressing position. The plunger 26 as well as the plunger 27 are in the material filling or insertion position. The core plunger 25 is located flush with the upper edge of the mold 21.

The fill volume in the mold 21 is determined by the mold 21, the movable plunger 26 and 27 as well as by the core plunger 25. The required volume is introduced, as well known, and, for example, in accordance with any suitable prior art arrangement.

After the mold 21 is filled, guide plate 18 is moved downwardly, hydraulically or pneumatically, with some space from the upper housing portion 28. The upper part A is then dropped vertically until the guide plate 18 engages the stops 20. When in this position, guide plate 18 is then clamped to the plate 24 by moving the balls 22 hydraulically or pneumatically into the locking grooves 30 of the bolts 19, see FIG. 2.

When the guide plate 18 is locked to the plate 24, the upper housing part 28 can move downwardly further. Since the spiral control matrix elements 13 are in interconnected engagement with the control cam cores 15—see FIGS. 5 and 6—the matrices 13 will be caused to rotate. This rotation is transmitted from the matrices 15 by the gears 12, coupled thereto, to the intermediate gear 11, which also be termed a central gear, and this rotation is transferred to the punch die 16. The punch die 16 is rotated before it enters into the mold 21 and, after entry, and further downward movement continues to rotate. As soon as the plunger 16 enters the powder mass, compaction thereof starts. When the plunger 16 has reached its design penetration depth, the mold 21 as well as the plunger 16 and the plunger 27 synchronously move downwardly. Due to the fixed plunger 26, further compaction will result. When the plunger 27 has reached the pressing position, continued vertical movement of the form 21 will, necessarily, cause rotation thereof and a final compaction of the powder mass to the final workpiece—see FIG. 2—will result.

Upon termination of the compaction step, the workpice has to be ejected or removed. FIG. 3 illustrates this removal process.

First, the die 21 is moved downwardly until the spiral contours 1 of the workpiece W are exposed. This is the stripping or removal position. Upon this vertical movement of the die 21, the plunger 27 is rotated by the die 21. Since the guide plate 18 is further rigidly coupled to the plate 24, the plunger 16 likewise is caused to rotate.

When the stripping position is reached, the guide plate 18 is uncoupled from the plate 24 by releasing pressure on the pistons 23, so that it can move downwardly, releasing the balls 22 from the coupling bolts 19.

The upper part A now moves upwardly. During this movement, the plunger 17 carries out a removal movement relative to the upper part A, and the workpiece W is pressed off from the plunger 16. Following this movement, the straight gear 2 of the hub portion of the workpiece is ejected by a vertical movement of the plunger 26.

The workpiece W can now be removed; the parts are then again moved into the fill position—see FIG. 1—and the operating cycle can repeat.

In accordance with a feature of the invention, the apparatus can be used also to calibrate or size workpieces which, after compaction, have been subjected to a sintering process. The sequence of steps is reversed by first pressing the straight gear portion 2 of the workpiece W into the complementary gearing 27*b* of the punch 27; thereafter, the inclined gearing 1 is pressed into the complementary inclined gearing 21*a* of the mold 21. To permit introduction of the workpiece W, the space between the guide plate 18 and the plate 24, preferably, is enlarged, for example by inserting a suitable different spacer 20 or placing an intermediate shim or washer thereon.

Various changes and modifications may be made within the scope of the inventive concept.

Control elements, including hydraulic or pneumatic elements, to move the respective components of the system and well known in connection with powder metal technology, have been omitted since they will be obvious to those skilled in the art. Likewise, the specific fluid connection to the locking arrangement 19, 21, 22, 30 is shown only generally, the element 22 having, as well known, an internally conical or tapered surface so that, upon movement thereof under hydraulic or pneumatic pressure in a vertical direction (compare FIGS. 1 and 2), the balls 22 can engage in the groove 30 even if the spacing of the stop element 20 with respect to the upper edge of the die 21 is changed. The modular arrangement, including the easy replaceability of the movement controlling connection system formed essentially by the core element 15 in engagement with the matrix element 13, to result in an essentially modular system, is compatible with numerous existing constructions of compacting presses.

We claim:

1. Apparatus for shaping a powder metal workpiece (W) having at least in part an outer helical contour or surface (1), said apparatus comprising a press mold (21) having an inner helical contour or surface;

a first rotatable and axially movable plunger or punch or ram (16);

a second rotatable and axially movable plunger or punch or ram (27);

a helical cam system (13, 15) controlling rotary movement of the first plunger or punch or ram (16) upon axial movement relative to the press mold, the helical cam system (13, 15) comprising a core element (15) having a helical outer contour and a matrix element (13) having an inner contour complementary to said helical outer contour;

a gear transmission (11, 12) between said helical cam system (13, 15) and said first plunger or punch or ram (16); and a guide plate (18) relatively movable with respect to said first plunger or punch or ram (16);

wherein one of said core element (15) and said matrix element (13) is securely connected to said guide plate (18);

the other one of said matrix element (13) and said core element (15) is coupled to a first gear (12) of said gear transmission, and wherein said first plunger or punch or ram (16) is coupled to a second gear (11) of said gear transmission, in rotation-transmitting engagement with said first gear (12).

2. The apparatus of claim 1, further including a support plate (24) retaining said second plunger, punch or ram (27);

and stop means (20) secured to said support plate (24) and facing said guide plate (18) so that, upon movement of the guide plate towards the support plate, the first plunger, punch or ram (16) will have started to rotate before it engages into the press mold (21).

3. The apparatus of claim 2, further including locking means to connect said guide plate (18) and said support plate (24) during compaction of powder metal material to form said workpiece, said locking means comprising a projecting element (19) projecting from one (18) of said plates and formed with a locking groove (30), and a reception element (31) secured to the other (24) of said plates, said reception element including fluid controlled and operated engagement elements (22) positioned for engagement in said groove (30) of said projecting element (19) when said plates are to be locked together.

4. Apparatus for shaping a powder metal workpiece (W) having at least in part an outer helical contour or surface (1), said apparatus comprising a press mold (21) having an inner helical contour or surface;

a first rotatable and axially movable plunger or punch or ram (16);

a second rotatable and axially movable plunger or punch or ram (27);

a helical cam system (13, 15) controlling rotary movement of the first plunger or punch or ram (16) upon axial movement relative to the press mold; and a gear transmission (11, 12) between said helical cam system (13, 15) and said first plunger or punch or ram (16); and wherein at least two helical cam systems (13, 15) are provided, circumferentially located around said first plunger or punch or ram (16).

5. The apparatus of claim 4, wherein the workpiece (W) is formed with an axial bore (3); and said first rotatable and axially movable plunger, punch or ram (16) comprises a two-part element including a central plunger, punch or ram (17) and an outer ram element **(16*a*), coaxially surrounding said central plunger, punch or ram (17), said central plunger, punch or ram being axially movable and rotatable and provided to form said bore (3)** in the workpiece;

and wherein said central plunger, punch or ram (17) is formed, at its terminal end, with an axial centering bore **(17*a*)**.

6. The apparatus of claim 4, wherein said second rotatable and axially movable plunger, punch or ram (27) is formed with inner contours **(27*b*) in accordance with a hub (2) to be generated, as part of said workpiece (W); and an additional rotatable and axially movable plunger, punch or ram (26) is located within said second plunger, punch or ram (27) and has an outer contour (26*a*) which is complementary to the inner contour (27*b*) of the second plunger, punch or ram to form the circumferential profile of said hub (2)** of the workpiece (W).

7. The apparatus of claim 6, further including a core plunger, punch or ram (25) located within said additional plunger, punch or ram (27) located rotatably and axially movable therein, to generate a bore (3) in the workpiece.

8. The apparatus of claim 5, further including an additional rotatable and axially movable plunger, punch or ram (26) located within said second plunger, punch or ram (27) and having an outer contour **(26*a*)** which is complementary to an inner contour (27*b*) of the second plunger, punch or ram to form a circumferential profile of a hub (2) of the workpiece (W); and a core plunger, punch or ram (25) located within said additional plunger, punch or ram (27) located rotatably and axially movable therein, to generate a bore (3) in the workpiece;

and wherein said core plunger, punch or ram (25) is positioned for reception within said axial centering bore (17*a*) of the central plunger, punch or ram (17).

9. Apparatus for shaping a powder metal workpiece (W) having at least in part an outer helical contour or surface (1), said apparatus comprising a press mold (21) having an inner helical contour or surface;

a first rotatable and axially movable plunger or punch or ram (16);

a second rotatable and axially movable plunger or punch or ram (27);

a helical cam system (13, 15) controlling rotary movement of the first plunger or punch or ram (16) upon axial movement relative to the press mold, the helical cam system (13, 15) comprising a core element (15) having a helical outer contour and a matrix element (13) having an inner contour complementary to said helical outer contour;

a gear transmission (11, 12) between said helical cam system (13, 15) and said first plunger or punch or ram (16);

a guide plate (18), relatively movable with respect to said first plunger or punch or ram (16), coupled to and movable with said helical cam system (13, 15); and connection means ((18*a*) connecting the guide plate to one (15) of said elements (13, 15) of the helical cam system.

10. The apparatus of claim 9, wherein said connection means (18*a*) connect the matrix element (13) to said guide plate (18).

11. The apparatus of claim 9, wherein the workpiece (W) is formed with an axial bore (3); and said first rotatable and axially movable plunger, punch or ram (16) comprises a two-part element including a central plunger, punch or ram (17) and an outer ram element (16*a*), coaxially surrounding said central plunger, punch or ram (17), said central plunger, punch or ram being axially movable and rotatable and provided to form said bore (3) in the workpiece;

and wherein said central plunger, punch or ram (17) is formed, at its terminal end, with an axial centering bore (17*a*).

12. The apparatus of claim 9, wherein said second rotatable and axially movable plunger, punch or ram (27) is formed with inner contours (27*b*) in accordance with a hub (2) to be generated, as part of said workpiece (W); and an additional rotatable and axially movable plunger, punch or ram (26) is located within said second plunger, punch or ram (27) and has an outer contour (26*a*) which is complementary to the inner contour (27*b*) of the second plunger, punch or ram to form the circumferential profile of said hub (2) of the workpiece (W).

* * * * *